United States Patent [19]

Chaput

[11] 4,403,775

[45] Sep. 13, 1983

[54] RANDOM INDICIA SELECTOR

[76] Inventor: Joseph R. Chaput, 9 Deer Park Cres., Apt. 1501, Toronto, Ontario, Canada, M4V 2C4

[21] Appl. No.: 388,092

[22] Filed: Jun. 14, 1982

[51] Int. Cl.[3] ..... A63F 7/04

[52] U.S. Cl. ..... 273/144 B

[58] Field of Search ..... 273/144, 138, 142, 143; 273/161

[56] References Cited

U.S. PATENT DOCUMENTS

| | | | |
|---|---|---|---|
| 526,946 | 10/1894 | Schleininger | 273/144 B |
| 3,289,321 | 12/1966 | Sussman | 273/144 B X |
| 3,435,541 | 4/1969 | Tacey | 434/199 |
| 4,368,887 | 1/1983 | Gamble | 273/144 B |

FOREIGN PATENT DOCUMENTS

| | | | |
|---|---|---|---|
| 2400738 | 4/1979 | France | 273/144 B |
| 853887 | 11/1960 | United Kingdom | 273/138 R |
| 897402 | 5/1962 | United Kingdom | 273/144 B |

*Primary Examiner*—Paul E. Shapiro

*Attorney, Agent, or Firm*—Peter McBurney; James A. LaBarre

[57] ABSTRACT

A random number selector has a compartment that accommodates balls of two contrasting colors, e.g., black and white. Overlying the compartment is a window on which are marked indicia to be selected, e.g., numbers. The indicia also are black. Certain of the numbers are masked and rendered invisible by the black balls located behind them. The numbers to be selected are highlighted by the color-contrasting white balls.

13 Claims, 4 Drawing Figures

RANDOM INDICIA SELECTOR

BACKGROUND OF THE INVENTION

This invention relates to apparatus for randomly selecting at least one of a plurality of indicia, which may be numbers, for example.

The embodiment of the invention that is described herein in detail was designed for the selection of lottery numbers, which is one of the uses to which the instant invention may be put, but, by no means the only use.

Many lotteries require that the participants select their own lottery numbers. While this often is done using various combinations of "personal" numbers, such as birth dates, etc., many people find the selection of a lottery number difficult. The instant invention provides simple, inexpensive apparatus that can be sold at the same locations as lottery tickets are purchased and which will generate random numbers to be chosen as lottery numbers.

SUMMARY OF THE INVENTION

According to one aspect of this invention there is provided apparatus for randomly selecting at least one indicia comprising a container having an enclosed compartment having at least first and second sections communicating with each other; a plurality of balls located in said compartment and moveable between said two sections thereof, some of said balls being of a first colour and at least one of said balls being of a second colour; a window in said container through which said balls in said second section can be viewed; a plurality of indicia also viewable when viewing said second section through said window, said indicia being of a colour that does not contrast with said first colour but does contrast with said second colour, said second section, balls, window and indicia being so constructed and arranged that when said balls are in said second section they are located behind said indicia relative to a person looking into said second section through said window and said indicia that are adjacent said balls of said first colour are masked by said colour of said balls of said first colour and thereby rendered substantially invisible, while said at least one ball of said second colour forms a colour contrasting background for the one of said indicia adjacent thereto and highlighting the latter indicia as the one to be selected.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENT

Figure 1:
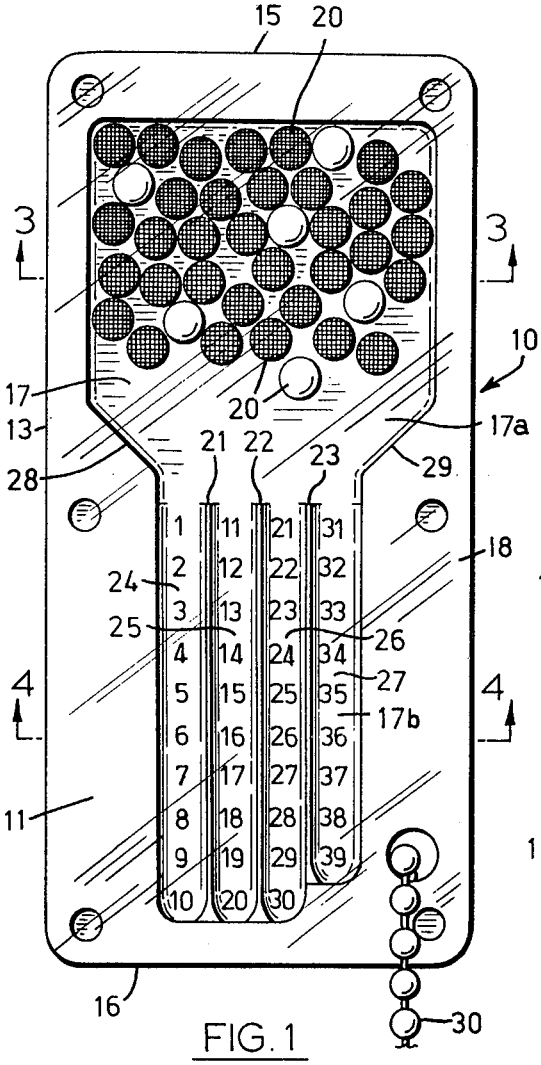
FIGS. 1 and 2 are plan views of a random number selector embodying this invention showing the balls which constitute a part thereof in two different locations.
Figure 2:
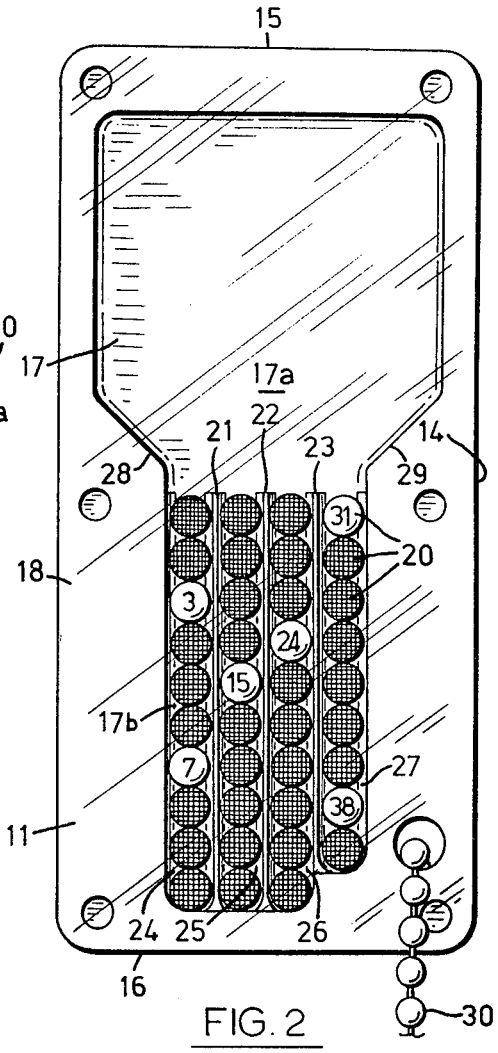

Referring particularly to FIGS. 1 and 2, a random number selector 10 embodying the present invention includes a container or housing 11 which, in the illustrated embodiment, is rectangular in configuration, but which may have any shape. Container 11 preferably is fabricated of a suitable plastics material and includes a lower part constituted by integral bottom 12, side 13 and 14, and end 15 and 16 walls. These walls define an enclosed compartment 17 that has two sections 17*a* and 17*b* that communicate with each other.

Overlying the whole upper surface 18 of the lower part of container 10 is a sheet 19 of material which preferably is fabricated of a suitable plastics material. Sheet 19 is secured to the lower part of container 10 by adhesive or by any other suitable technique, e.g. screws, plastic welding or snap fitting.

In the embodiment shown, which is the preferred embodiment, the whole of sheet 19 is transparent, but this is not essential. However, the part of sheet 19 that covers compartment section 17*b* must be transparent.

Located within compartment 17 are a plurality of balls 20. Some of these balls are of a first colour, which happens to be black in the preferred embodiment, while at least one of the balls is of a different colour, which happens to be white in the preferred embodiment. The number of balls 20 that are of the latter colour correspond to the number of indicia to be selected, while the total number of balls 20 correspond to the total number of indicia. Balls 20 preferably are fabricated of a suitable plastics material and are all of the same diameter. The size of balls 20 and the depth of compartment 17 is such that the balls can move freely in compartment 17.

Compartment section 17*a* has a greater volume than that required to accommodate all of balls 20 so that when the balls are in this compartment section and container 11 is shaken, the balls may move about and redistribute themselves.

Compartment section 17*b* is divided, in the embodiment illustrated, into four channels 24, 25, 26 and 27 by means of three parallel dividing walls 21, 22 and 23 upstanding from and integral with bottom wall 12. The width of each of the four channels is just sufficient to accommodate balls 20.

Marked on or in the part of plate 19 that overlies channels 24–27 are four rows of indicia. In the present case the indicia are the numbers 1–39 with numbers 1–10 overlying channel 24, numbers 11–20 overlying channel 20, numbers 21–31 overlying channel 26 and numbers 31–39 overlying channel 27.

It will be noted that channel 27 is shorter than the other channels. This is because it is overlaid by only nine numbers and will accommodate only nine of balls 20, whereas the other channels each are overlaid by ten numbers and will accommodate ten of balls 20.

The random number selector shown will select numbers from 1–39. If it were desired to select numbers from 1–40, channel 27 could be made as long as the other channels and the indicia 40 added below the indicia 39. Likewise the number of channels could be increased or decreased to permit selection from among more or fewer numbers.

While in the present embodiment the indicia are numbers, other indicia such as symbols, letters, etc. could be used.

The spacing between the indicia overlying each channel is important. The center-to-center distance is equal to the diameter of a ball 20, so that when the balls are in the channels, each ball is aligned with one of the indicia, as is best shown in FIG. 2.

As previously noted, the number of balls 20 corresponds to the total number of indica (39), so that when balls 20 are in compartment section 17*b*, they totally occupy the same, as shown in FIG. 2.

The indicia 1–39 are of substantially the same colour as the black balls 20 and, of course, markedly contrast in colour with the white balls 20, about which more will be said later.

It will be noted that compartment section 17*a* has inclined side walls 28 and 29 adjacent compartment section 17*b*. This is not essential but effectively serves to funnel balls 20 from compartment section 17*a* into compartment section 17*b*.

Optionally the random number selector may be provided with a key chain 30.

The random number selector illustrated is for choosing six numbers out of thirty-nine. Consequently, there are thirty-nine balls 20 of which six are white and thirty-three are black, and there are thirty-nine black indicia running from one to thirty-nine.

In use the apparatus is held in such a way that all of balls 20 are in compartment section 17*a*, as shown in FIG. 1. In this position the random number selector may be shaken or vibrated to randomly orient balls 20. The apparatus then is tilted to permit balls 20 to funnel into compartment section 17*b*, as shown in FIG. 2. Balls 20 locate themselves directly behind the indicia relative to a person looking through sheet 19 into compartment section 17*b*. Those of the indicia that are adjacent the black balls are masked thereby and rendered substantially invisible, as best shown in FIG. 2, while the white balls form colour contrasting backgrounds for the indicia that are adjacent thereto highlighting the latter as the ones to be selected—in FIG. 2 the numbers 3, 7, 15, 24, 31 and 38.

If desired, a third colour of ball could be introduced to select a special additional number. The colour of this ball also should contrast with the colour of the indicia being selected. For example, there could be five white balls and one green ball selecting a total of six numbers but with the green ball selecting a special number for another aspect of the lottery.

A random number selector is known in which different coloured balls align themselves in channels beside rather than beneath the numbers to be selected. This is not as effective as the instant invention as all of the numbers remain visible, none being masked and none being highlighted.

Figure 3:
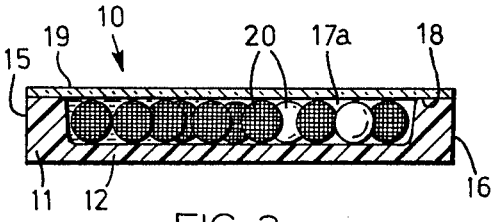
FIG. 3 is a section taken along line 3—3 in FIG. 1.
Figure 4:
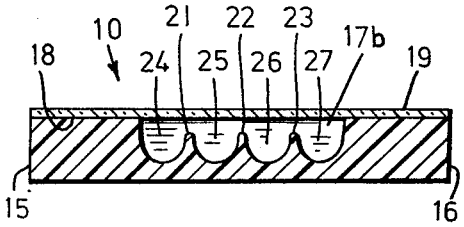
FIG. 4 is a section taken along line 4—4 in FIG. 1.

A random number selector also is shown in U.S. Pat. No. 3,289,321 issued Dec. 6, 1966, M. V. Sussman. In the Sussman selector different coloured balls align beneath rather than beside the numbers to be selected, as in the present invention, but, as shown in FIG. 3 of the Sussman patent, all of the numbers remain visible at all times.

While a preferred embodiment of the invention has been described in detail, those skilled in the art will appreciate that changes and modifications may be made therein without departing from the spirit and scope of the invention as defined in the appended claims.

I claim:

1. Apparatus for randomly selecting at least one indicia comprising a container having an enclosed compartment having at least first and second sections communicating with each other; a plurality of balls located in said compartment and moveable between said two sections thereof, some of said balls being of a first colour and at least one of said balls being of a second colour; a window in said container through which said balls in said second section can be viewed; a plurality of indicia also viewable when viewing said second section through said window, said indicia being of a colour that does not contrast with said first colour but does contrast with said second colour, said second section, balls, window and indicia being so constructed and arranged that when said balls are in said second section they are located behind said indicia relative to a person looking into said second section through said window and said indicia that are adjacent said balls of said first colour are masked by said colour of said balls of said first colour and thereby rendered substantially invisible, while said at least one ball of said second colour forms a colour contrasting background for the one of said indicia adjacent thereto and highlighting the latter indicia as the one to be selected.

2. Apparatus according to claim 1 wherein said first colour is black, said second colour is white and said indicia are black.

3. Apparatus according to claim 1 wherein said indicia are numbers.

4. Apparatus according to claim 3 wherein the number of said balls equals the number of said indicia.

5. Apparatus according to claim 4 wherein said first colour is black, said second colour is white and said indicia are black.

6. Apparatus according to claim 1 wherein the number of said balls equals the number of said indicia.

7. Apparatus according to claim 1 wherein said second section is divided into a plurality of parallel, side-by-side arranged channels.

8. Apparatus according to claim 7 wherein said indicia overlie said channels.

9. Apparatus according to claim 8 wherein each of said balls has the same diameter and wherein the spacing between adjacent indicia overlying each said channel equals the diameter of one of said balls such that said balls locate themselves beneath and in registry with said indicia.

10. Apparatus according to claim 9 wherein said indicia are numbers.

11. Apparatus according to claim 10 wherein the number of said balls equals the number of said indicia.

12. Apparatus according to claim 11 wherein said first colour is black, said second colour is white and said indicia are black.

13. Apparatus according to claim 9 wherein the number of said balls equals the number of said indicia.

* * * * *